US009369811B2

(12) United States Patent
Akino

(10) Patent No.: US 9,369,811 B2
(45) Date of Patent: Jun. 14, 2016

(54) CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 14/680,696

(22) Filed: Apr. 7, 2015

(65) Prior Publication Data

US 2015/0312682 A1 Oct. 29, 2015

(30) Foreign Application Priority Data

Apr. 24, 2014 (JP) ..... 2014-090201

(51) Int. Cl.

| | |
|---|---|
| ***H04R 19/04*** | (2006.01) |
| ***H04R 3/00*** | (2006.01) |
| ***H04R 19/01*** | (2006.01) |
| *H04R 1/02* | (2006.01) |
| *H04R 1/04* | (2006.01) |
| *H04R 31/00* | (2006.01) |
| *H01R 13/703* | (2006.01) |

(52) U.S. Cl.

CPC ..... *H04R 19/04* (2013.01); *H04R 3/007* (2013.01); *H04R 19/016* (2013.01); *H01R 13/703* (2013.01); *H04R 1/021* (2013.01); *H04R 1/04* (2013.01); *H04R 31/006* (2013.01)

(58) Field of Classification Search

CPC ..... H04R 1/021; H04R 1/04; H04R 1/06; H04R 3/00; H04R 3/007; H04R 19/00; H04R 19/04; H04R 31/006; H04R 2410/03; H04R 2410/05; H01R 13/703

See application file for complete search history.

(56) References Cited

U.S. PATENT DOCUMENTS

| | | | | |
|---|---|---|---|---|
| 4,316,304 A * | 2/1982 | Parise | A47L 9/2868 | 15/339 |
| 4,652,067 A * | 3/1987 | Lutzenberger | H01R 13/703 | 200/51.09 |
| 4,652,702 A * | 3/1987 | Yoshii | H04R 1/46 | 29/594 |
| 5,490,033 A * | 2/1996 | Cronin | H01R 13/6485 | 361/212 |
| 6,893,284 B1 * | 5/2005 | Fawcett | H01R 13/533 | 439/258 |
| 7,041,918 B1 * | 5/2006 | Wu | H01R 13/703 | 200/51.09 |

(Continued)

FOREIGN PATENT DOCUMENTS

JP 2012-065147 A 3/2012

*Primary Examiner* — Curtis Kuntz
*Assistant Examiner* — Joshua Kaufman
(74) *Attorney, Agent, or Firm* — Manabu Kanesaka

(57) ABSTRACT

A microphone unit includes a first connection terminal abutting on a terminal on a microphone body side, a second connection terminal connected on a fixed electrode side, and a coil spring provided between the first connection terminal and the second connection terminal, compressed upon coupling of the microphone unit and the microphone body, and urging the first connection terminal toward the microphone body. When the microphone unit and the microphone body are coupled, the first connection terminal and the second connection terminal are connected, and the first connection terminal is connected to the terminal on the microphone body side. When the microphone unit and the microphone body are separated from each other, the first connection terminal and the second connection terminal are separated from each other by an urging force of the coil spring.

6 Claims, 3 Drawing Sheets

(56) References Cited

U.S. PATENT DOCUMENTS 9,083,110 B2 * 7/2015 McClelland ..... H01R 13/6205
2005/0063557 A1 * 3/2005 Akino ..... H04R 1/38 381/174
2006/0045302 A1 * 3/2006 Akino ..... H04R 1/06 381/355
2006/0120544 A1 * 6/2006 Akino ..... H04R 19/016 381/174
2006/0251274 A1 * 11/2006 Akino ..... H04R 1/04 381/111
2008/0144875 A1 * 6/2008 Akino ..... H04R 1/086 381/361
2010/0189298 A1 * 7/2010 Akino ..... H04M 1/035 381/356
2012/0063629 A1 * 3/2012 Akino ..... H04R 1/086 381/355
2014/0099808 A1 * 4/2014 McClelland ..... H01R 13/6205 439/153
2015/0092975 A1 * 4/2015 Akino ..... H04R 1/08 381/355
2015/0312682 A1 * 10/2015 Akino ..... H04R 23/00 381/174
2015/0318638 A1 * 11/2015 McClelland ..... H01R 13/629 439/105

* cited by examiner

CONDENSER MICROPHONE

RELATED APPLICATIONS

The present application is based on, and claims priority from, Japanese Application No. JP2014-090201 filed Apr. 24, 2014, the disclosure of which is hereby incorporated by reference herein in its entirety.

BACKGROUND OF THE INVENTION

1. Field of the Invention

The present invention relates to a condenser microphone which has a separable microphone unit including a diaphragm vibrating in response to sound waves and a fixed electrode arranged to face the diaphragm, and a body having a circuit portion for processing audio signals. More particularly, the present invention relates to a condenser microphone which can prevent problems, such as burnout of the diaphragm, from being caused when the microphone unit is removed.

2. Description of the Related Art

One condenser microphone may include, for example, two condenser microphone units, as disclosed in JP 2012-65147 A. This condenser microphone is configured to have directivity variable by adjusting a polarization voltage applied to each of the units, but such a condenser microphone is disadvantageously expensive in cost.

While, a condenser microphone is known which has a changeable microphone unit (head case) configured to be removed from a microphone body accommodating a circuit portion or the like for processing audio signals. According to this configuration, only units having different directivities need to be interchanged to readily achieve a variable directivity microphone at low cost.

FIG. 5 is a side view of the conventional condenser microphone having a removable microphone unit, and FIG. 6 is a cross-sectional view of the conventional condenser microphone. It is noted that FIGS. 5 and 6 illustrate the condenser microphone in which a microphone unit is removed from a condenser microphone body.

The illustrated condenser microphone 50 includes a microphone unit 52 and a microphone body 51. The microphone unit 52 converts sound waves to audio signals. The microphone body 51 accommodates a circuit portion for processing the audio signals received from the microphone unit 52, and the like. The microphone unit 52 is removably mounted, for example threadedly engaged, to the microphone body 51.

The microphone body 51 has a hollow cylindrical casing 53 for shielding static electricity. The casing 53 accommodates the circuit portion 54, a connector 55, and the like.

Further, the microphone unit 52 has a head case 65 formed with a large number of openings, and the head case 65 accommodates a unit body 56 including a fixed electrode and a diaphragm. Further, the microphone unit 52 has a pin input terminal 57, and a signal output terminal 59. The pin input terminal 57 is connected to the fixed electrode of the unit body 56, and disposed in back of the unit body 56. The signal output terminal 59 is connected to the pin input terminal 57 through a coil spring 58.

Further, a connection terminal 60 is provided in a front end opening of the microphone body 51 to receive abutment of a front end of the signal output terminal 59. The connection terminal 60 is connected to the circuit portion 54 side.

The microphone unit 52 is threadedly engaged with, for example, the front end opening of the casing 53 in the microphone body 51. As the result, the front end of the signal output terminal 59 is pressed against the connection terminal 60 by an urging force of the coil spring 58. Therefore, the unit body 56 and the circuit portion 54 are electrically connected, and the microphone unit 52 functions as a microphone.

Further, the condenser microphone 50 configured as described above may have a common specification of a coupled portion between the microphone unit 52 and the microphone body 51. The common specification allows interchange of only the microphone units 52 having different directivities. Accordingly, a variable directivity microphone having the common microphone body 51 can be readily achieved.

With the condenser microphone 50 having the above-mentioned configuration, a charged human body (150 to 200 pF) may make contact with the signal output terminal 59 during mounting and dismounting of the microphone unit 52. At this time, a static voltage (3 kV to 10 kV) is applied between the diaphragm and the fixed electrode. Therefore, this causes a problem in that the diaphragm is attracted to the fixed electrode, and the diaphragm is likely to be broken.

While, an omnidirectional unit employs stiffness control, and has a highly stretched diaphragm. Therefore, the problem of attraction of the diaphragm to the fixed electrode is reduced. However, a high voltage applied between the diaphragm and the fixed electrode causes a problem in that spark discharge occurs and the diaphragm is broken.

Further, with an electret condenser microphone unit, even if a diaphragm is not broken, electret may have a reduced surface potential. As a result, this causes a problem of deterioration in sensitivity of the electret condenser microphone unit.

SUMMARY OF THE INVENTION

The present invention has been made in view of the above-mentioned problems, and it is an object of the present invention to provide a condenser microphone which has a microphone unit including a diaphragm vibrating in response to sound waves and a fixed electrode arranged to face the diaphragm, and a microphone body that accommodates a circuit portion receiving audio signals input from the microphone unit through a signal output terminal, wherein the microphone unit and the microphone body are separable from each other, and with which even if a charged person makes contact with the signal output terminal when mounting and dismounting the microphone unit, burnout or the like of the diaphragm can be prevented.

In order to solve the problems described above, the condenser microphone according to an embodiment of the present invention has a microphone unit including a diaphragm vibrating in response to sound waves and a fixed electrode that is arranged to face the diaphragm, and a microphone body that accommodates a circuit portion receiving audio signals input from the microphone unit through a signal output terminal, wherein the microphone unit and the microphone body are separable from each other. The microphone unit further includes a first connection terminal abutting on a terminal on the microphone body side, a second connection terminal connected on the fixed electrode side, and a coil spring provided between the first connection terminal and the second connection terminal, compressed upon coupling of the microphone unit and the microphone body, the coil spring configured to urge the first connection terminal toward the microphone body. When the microphone unit and the microphone body are coupled, the first connection terminal and the second connection terminal are connected, and the first connection terminal is connected to the terminal on the microphone body side. When the microphone unit and the microphone body are separated from each other, the first connection terminal and the second connection terminal are separated from each other by an urging force of the coil spring.

A distance between the first connection terminal and the second connection terminal upon separation of the microphone unit and the microphone body is preferably defined as a distance in which air breakdown is not caused at least between the first connection terminal and the second connection terminal by a static voltage applied upon contact between a human body and the first connection terminal.

In addition, the coil spring preferably includes a non-conductive material.

Owing to such a configuration, when the microphone unit is removed from the microphone body, the first connection terminal and the second connection terminal are separated from each other, and the first connection terminal and the fixed electrode are electrically insulated from each other.

Therefore, even if a charged human body makes contact with the first connection terminal, a voltage of static electricity charged on the human body is prevented from being transmitted to the fixed electrode. Therefore, problems, such as breakage of the diaphragm, caused by the static electricity can be prevented.

With an electret condenser microphone unit, reduction in surface potential of the electret by the static electricity is also prevented. Therefore, deterioration in sensitivity of the electret condenser microphone unit can be prevented.

A condenser microphone can be obtained which has a microphone unit including a diaphragm vibrating in response to sound waves and a fixed electrode that is arranged to face the diaphragm, and a microphone body that accommodates a circuit portion receiving audio signals input from the microphone unit through a signal output terminal, wherein the microphone unit and the microphone body are separable from each other, and with which even if a charged person makes contact with the signal output terminal when mounting and dismounting the microphone unit, burnout or the like of the diaphragm can be prevented.

DESCRIPTION OF THE PREFERRED EMBODIMENTS

Figure 1:
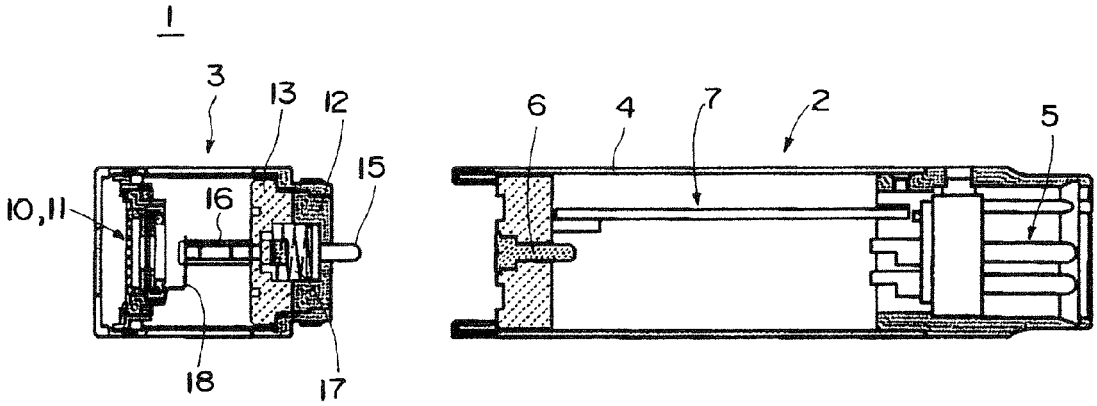
FIG. 1 is a cross-sectional view of a condenser microphone according to an embodiment of the present invention, illustrating separation of a microphone unit from a microphone body.
Figure 2:
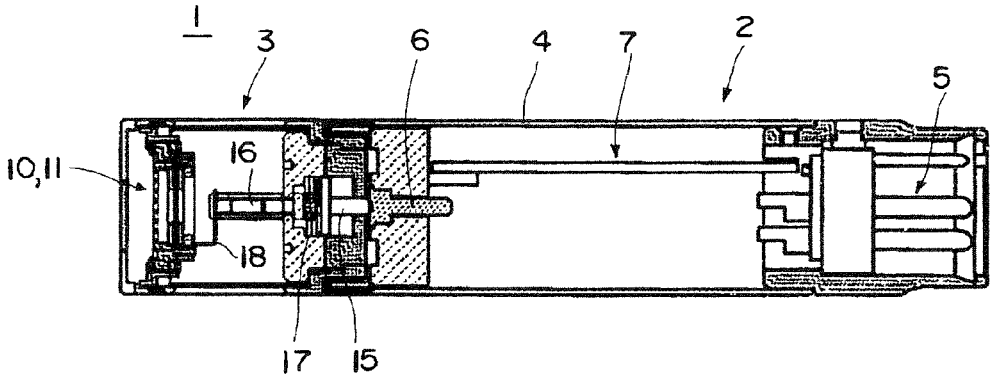
FIG. 2 is a cross-sectional view of the condenser microphone according to the embodiment of the present invention, illustrating mounting of the microphone unit to the microphone body.
Figure 3:
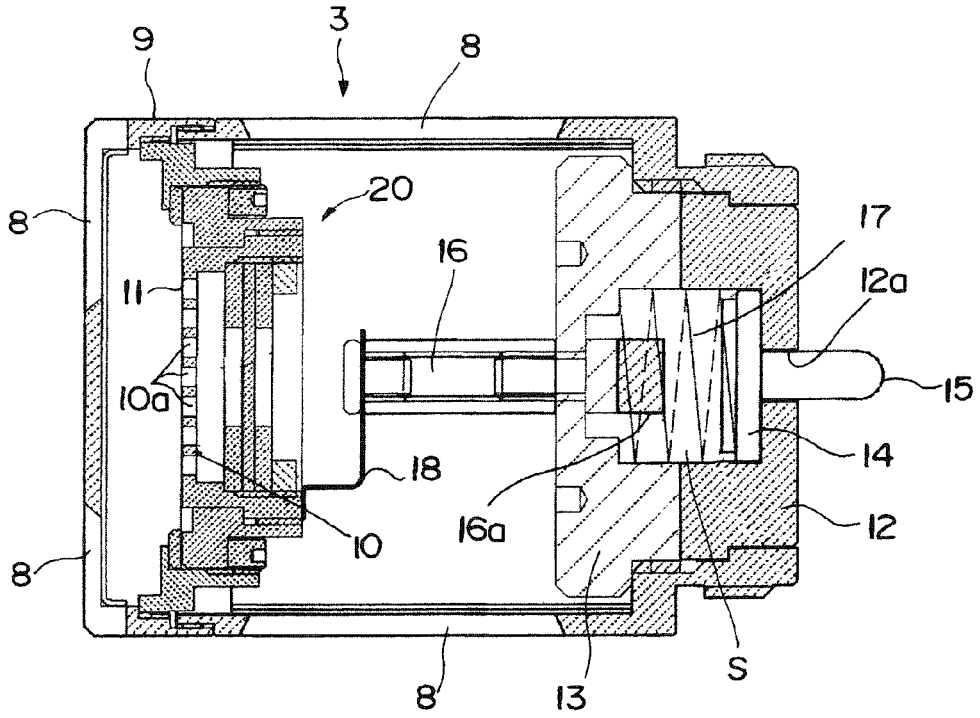
FIG. 3 is an enlarged cross-sectional view of the microphone unit of FIG. 1.
Figure 4:
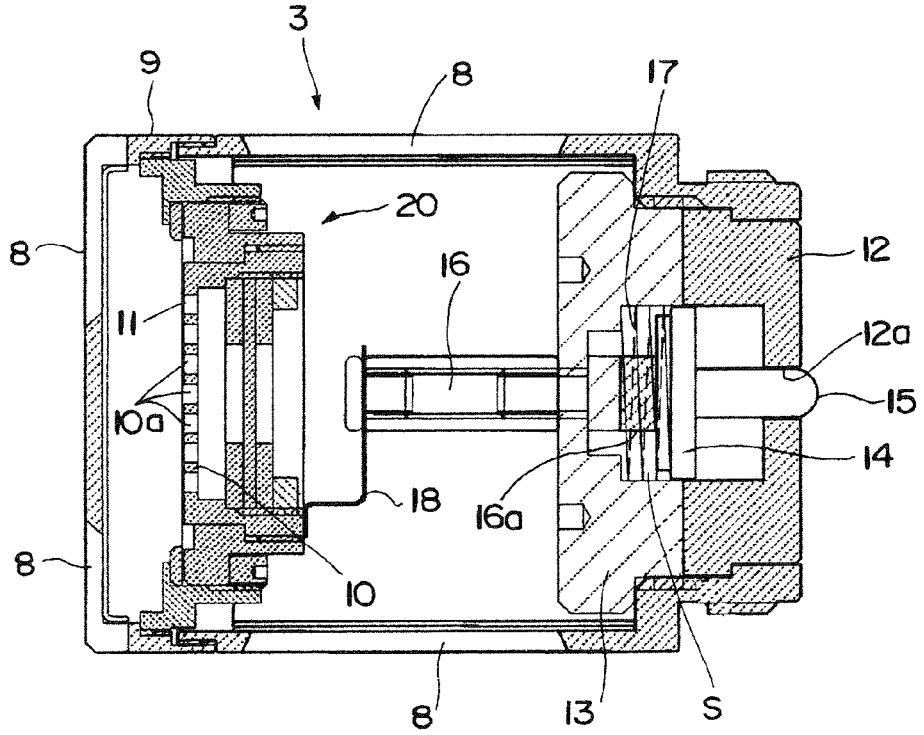
FIG. 4 is an enlarged cross-sectional view of the microphone unit of FIG. 2.
Figure 5:
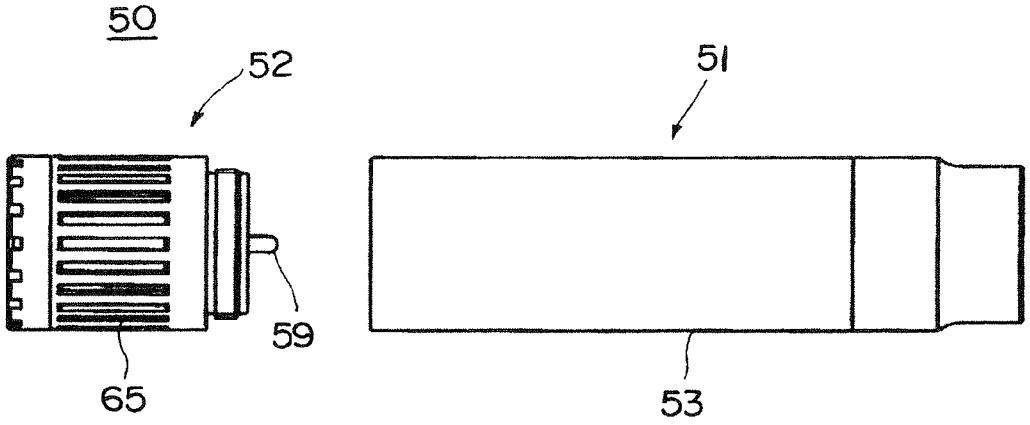
Fig. 5 Prior Art
FIG. 5 is a side view of a conventional condenser microphone having a removable microphone unit.
Figure 6:
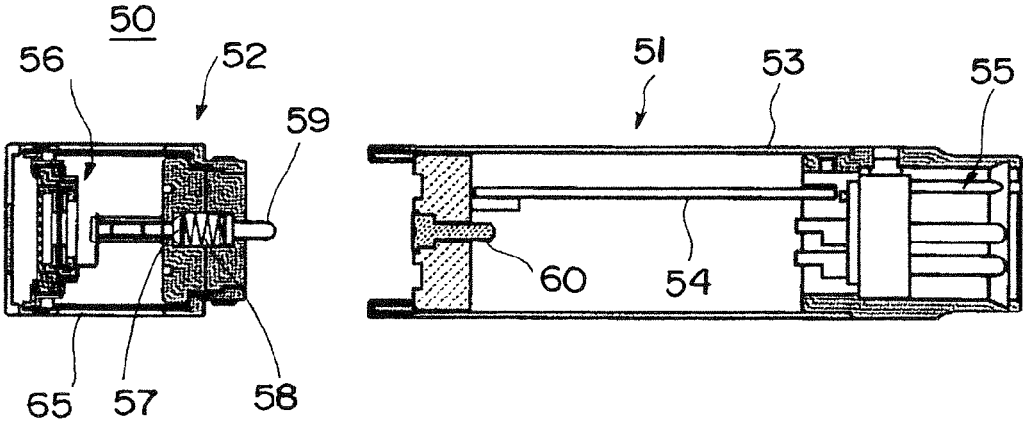
Fig. 6 Prior Art
FIG. 6 is a cross-sectional view of the condenser microphone of FIG. 5.

An embodiment of the present invention will be described below with reference to drawings. FIGS. 1 and 2 are cross-sectional views of the condenser microphone according to the embodiment of the present invention. FIG. 1 illustrates separation of a microphone unit and a microphone body which will be described below. FIG. 2 illustrates coupling of the microphone unit and the microphone body. FIG. 3 is an enlarged cross-sectional view of the microphone unit of FIG. 1. FIG. 4 is an enlarged cross-sectional view of the microphone unit of FIG. 2.

The condenser microphone 1 illustrated in FIGS. 1 and 2 includes the microphone unit 3 configured to convert sound waves to audio signals, and the microphone body 2 configured to process the audio signals received from the microphone unit 3. The microphone unit 3 is configured to be removably mounted, for example threadedly engaged, to the front end side of the microphone body 2.

The microphone body 2 has a hollow cylindrical casing 4 functioning as a shield case for shielding static electricity. The casing 4 has a rear end side (right side in figure) provided with a connector pin 5. The casing 4 has a front end side in the casing (left side in figure) provided with a connection terminal 6. The casing 4 has a center part accommodating a circuit portion 7 configured to process the audio signals.

Meanwhile, as illustrated enlarged in FIGS. 3 and 4, the microphone unit 3 includes a head case 9 formed with a plurality of openings 8. The head case 9 has a front part (left side in figure) provided with a unit body 20. The unit body 20 has a fixed electrode 10 bored with a plurality of holes 10*a*, and a film-type diaphragm 11 stretched to face the fixed electrode 10. The fixed electrode 10 and the diaphragm 11 are disposed to have a predetermined space therebetween.

The head case 9 has a rear part (right side in figure) provided with a disk-shaped cap portion 12 configured to close a rear part of the case, and a disk-shaped fixing plate 13 configured to fix the cap portion 12. The fixing plate 13 presses and fixes the cap portion 12 from the inside of the case. Both of the cap portion 12 and the fixing plate 13 in FIGS. 3 and 4 include a non-conductive material. The cap portion 12 and the fixing plate 13 are provided to be superposed on each other, so that a dimension in a thickness direction (axial direction) is increased. The head case 9 has an inside provided with a cylinder chamber S formed into a hollow cylindrical shape along the axial direction.

The cylinder chamber S has an inside provided with a disk-shaped piston portion 14 (first connection terminal) including a conductive material to be reciprocated in the axial direction. The cap portion 12 is formed with a through-hole 12*a* penetrating outward from the cylinder chamber S. The piston portion 14 has one side (cap portion 12 side) provided with an upright rod-shaped signal output terminal 15 (first connection terminal), and the signal output terminal 15 is slidably inserted into the through-hole 12*a*.

The fixing plate 13 is fixedly provided with a rod-shaped connection terminal 16 (second connection terminal) from inside the cylinder chamber S toward the unit body 20. The connection terminal 16 has a terminal head portion 16*a* disposed on a back side (fixing plate 13 side) of the piston portion 14 of the cylinder chamber S.

Further, in the cylinder chamber S, a coil spring 17 is provided between the back side of the piston portion 14 and the fixing plate 13. The coil spring 17 urges the connection terminal 16 in a direction in which the connection terminal 16 projects from the cap portion 12. The coil spring 17 is provided helically along a peripheral wall of the cylinder chamber S, and the cylinder chamber S has a diameter set so that the peripheral wall is fully separated from the head portion 16*a* of the connection terminal 16. More preferably, the coil spring 17 includes a non-conductive material (e.g., ceramic coil).

To the connection terminal 16, one end of a metal fitting 18 is connected, and the other end of the metal fitting 18 is connected to the fixed electrode 10.

When the microphone unit 3 configured as described above is coupled to the microphone body 2, the coil spring 17 is compressed. As illustrated in FIGS. 2 and 4, the signal output terminal 15 has a front end pressed against the connection terminal 6 of the microphone body 2 by an urging force of the coil spring 17. Further, when the piston portion 14 abuts on the terminal head portion 16*a* of the connection terminal 16, the signal output terminal 15 and the connection terminal 16 are electrically connected. That is, the circuit portion 7 of the microphone body 2 and the fixed electrode 10 of the microphone unit 3 are electrically connected.

Meanwhile, when the microphone unit 3 is removed from the microphone body 2, the coil spring 17 expands, as illustrated in FIGS. 1 and 3. Then, the piston portion 14 and the head portion 16*a* of the connection terminal 16 are separated from each other. Accordingly, even if the charged human body makes contact with the signal output terminal 15, the problems, such as breakage of the diaphragm or deterioration in sensitivity, can be prevented owing to the connection terminal 16 electrically separated.

It is noted that, in a condition as illustrated in FIG. 3, a distance between the piston portion 14 and the head portion 16*a* of the connection terminal 16 which are separated from each other is larger than a distance causing spark discharge at least according to Paschen's law. That is, the piston portion 14 (signal output terminal 15) and the connection terminal 16 are separated from each other to have a distance in which at least air breakdown (spark discharge) is not caused by a static voltage (3 kV to 10 kV) applied upon contact between the human body and the signal output terminal 15.

As described above, according to the embodiment of the present invention, when the microphone unit 3 is removed from the microphone body 2, the connection terminal 16 (terminal head portion 16*a*) and the signal output terminal 15 (piston portion 14) are separated from each other to have a distance in which at least the air breakdown is not caused, and the signal output terminal 15 and the fixed electrode 10 are electrically insulated from each other.

Therefore, even if a charged human body makes contact with the signal output terminal 15, the static voltage is prevented from being transmitted to the fixed electrode, and the problem such as the breakage of the diaphragm can be prevented.

Further, with an electret condenser microphone unit, deterioration in sensitivity caused by reduction in surface potential of an electret can be prevented.

What is claimed is:

1. A condenser microphone comprising:

a microphone unit including a diaphragm vibrating in response to sound waves, a fixed electrode arranged to face the diaphragm, a first connection terminal arranged at one end of the microphone unit, a second connection terminal disposed between the fixed electrode and the first connection terminal and connected on the fixed electrode, and a coil spring provided between the first connection terminal and the second connection terminal; and a microphone body removably connected to the microphone unit, and including a terminal abutting against the first connection terminal, and a circuit portion accommodated in the microphone body and receiving audio signals input from the microphone unit through the terminal, wherein the coil spring is compressed upon coupling of the microphone unit and the microphone body to urge the first connection terminal toward the microphone body, when the microphone unit and the microphone body are coupled, at first, the first connection terminal is directly contacted with and electrically connected to the terminal of the microphone body, and thereafter the first connection terminal and the second connection terminal are directly contacted with and electrically connected to each other, and when the microphone unit and the microphone body are separated from each other, the first connection terminal and the second connection terminal are separated from each other by an urging force of the coil spring to electrically disconnect therebetween.

2. The condenser microphone according to claim 1, wherein a distance between the first connection terminal and the second connection terminal upon separation of the microphone unit and the microphone body is at least larger than a distance causing spark discharge according to Paschen's law.

3. The condenser microphone according to claim 2, wherein the coil spring is non-conductive.

4. The condenser microphone according to claim 1, wherein the coil spring is non-conductive.

5. The condenser microphone according to claim 4, further comprising a cap portion arranged at the one end of the microphone unit, and a fixing plate arranged adjacent to the cap portion in the microphone unit to fix the cap portion, the cap portion and the fixing plate forming a cylinder chamber thereinside to accommodate the coil spring, wherein the first connection terminal is arranged in the cylinder chamber such that one end of the first connection terminal protrudes from the cap portion toward the microphone body, and the second connection terminal is arranged such that a terminal head portion of the second connection terminal is disposed in the cylinder chamber through a rear portion of the fixing plate, the fixing plate includes an inner wall and a step portion protruding inwardly from the inner wall to form the cylinder chamber, and the coil spring is arranged between the step portion and another end of the first connection terminal, and the terminal head portion of the second connection terminal is disposed inside the coil spring without contacting the coil spring in the cylinder chamber.

6. The condenser microphone according to claim 4, wherein the first connection terminal includes a rod-shaped portion protruding toward the terminal of the microphone body, and the rod-shaped portion has a length in a protruding direction such that one end of the first connection terminal is directly contacted to the second connection terminal when another end of the first connection terminal is pushed by the terminal of the microphone body to couple the microphone unit and the microphone body.

* * * * *